United States Patent [19]

Scott

[11] Patent Number: 4,811,440

[45] Date of Patent: Mar. 14, 1989

[54] COMBINATION HOOD SUPPORT, JACK CRANK, LUG WRENCH AND WHEEL COVER REMOVAL APPARATUS

[76] Inventor: Robert S. Scott, 3043 W. Clinton St., Phoenix, Ariz. 85029

[21] Appl. No.: 205,476

[22] Filed: Jun. 13, 1988

[51] Int. Cl.[4] ..... B25F 1/00

[52] U.S. Cl. ..... 7/100; 7/138; 29/245; 81/177.2

[58] Field of Search ..... 7/100, 138, 170; 81/177.2; 29/245, 273; 180/69.21

[56] References Cited

U.S. PATENT DOCUMENTS

| | | | |
|---|---|---|---|
| 3,649,976 | 3/1972 | Isom | 7/100 |
| 3,779,106 | 12/1973 | Cavicchi | 7/100 |
| 4,586,579 | 5/1986 | Matsui et al. | 180/69.21 |
| 4,607,406 | 8/1986 | Davis, Jr. | 7/138 |
| 4,765,009 | 8/1988 | Hung | 7/100 |

*Primary Examiner*—Roscoe V. Parker

*Attorney, Agent, or Firm*—H. Gordon Shields

[57] ABSTRACT

Combination hood support for supporting the hood of an automotive vehicle, jack crank, lug wrench, and wheel cover/hub cap pry tool includes a relatively long rod portion and a relatively short rod portion disposed at a predetermined angle to the relatively long rod portion, and the angle is preferably about 90 degrees. The apparatus is normally stowed beneath the hood of the vehicle and pivots into its hood support functional position and is removable for its jack crank function. The apparatus is also separable so that a portion may be used as a lug wrench and as a pry bar for hub caps and wheel covers.

16 Claims, 1 Drawing Sheet

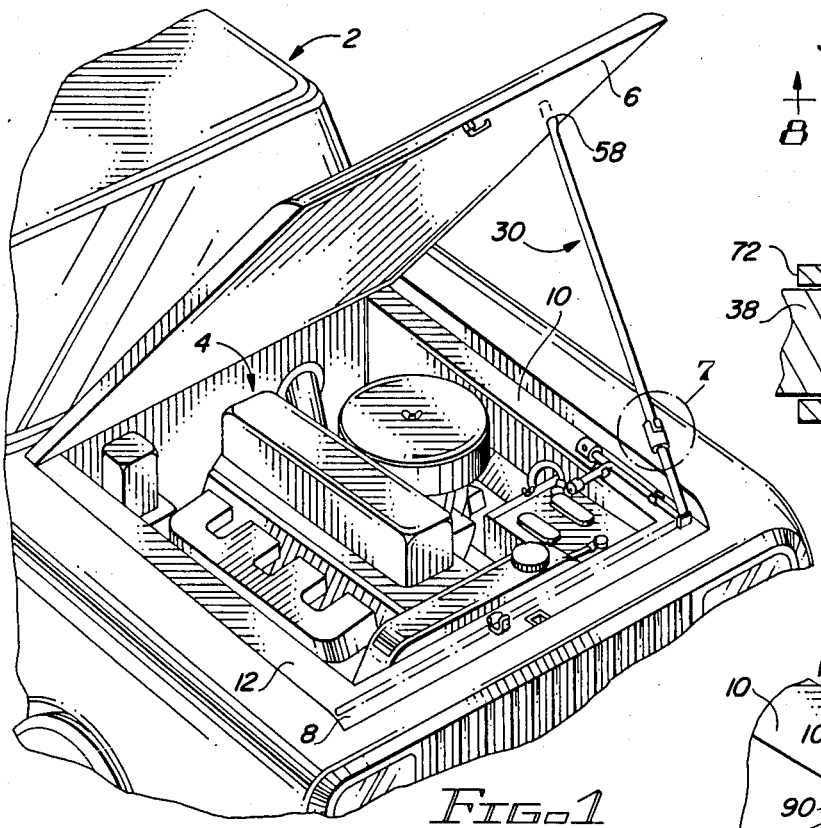
FIG. 1
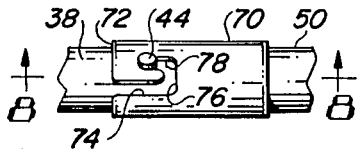
FIG. 7
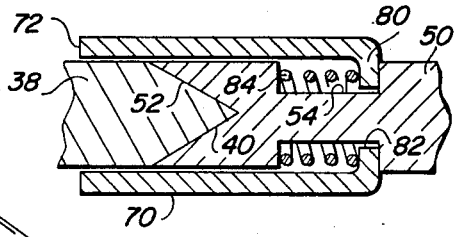
FIG. 8
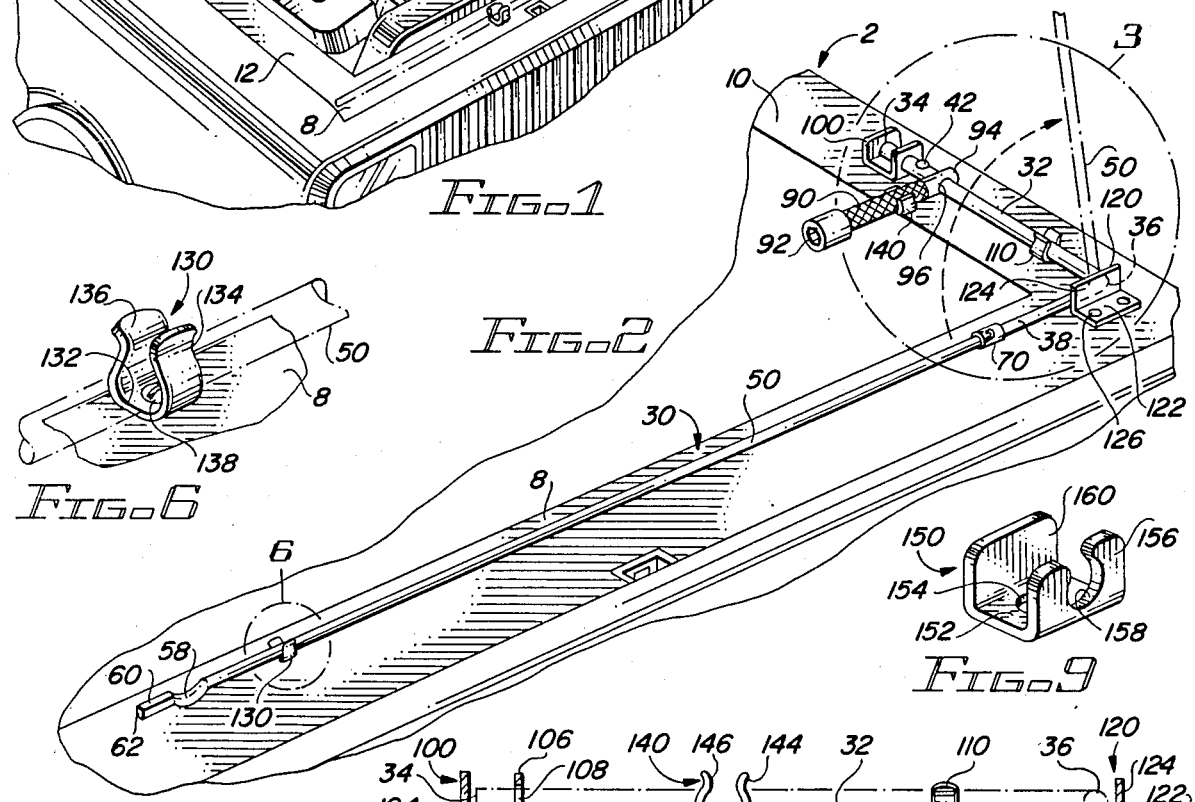
FIG. 2
FIG. 6
FIG. 9
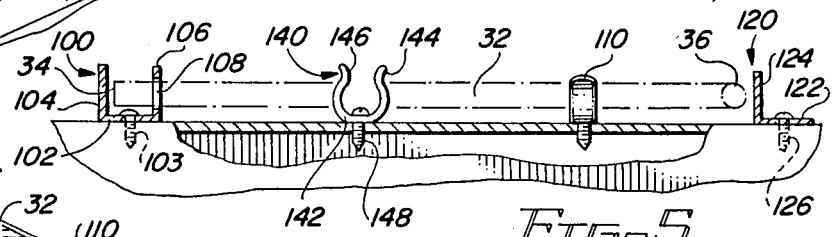
FIG. 5
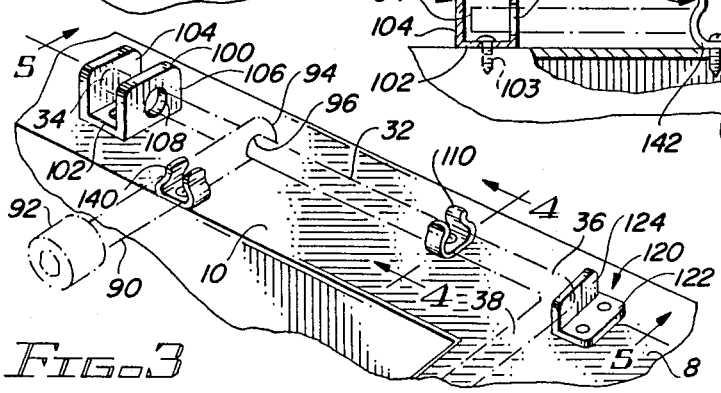
FIG. 3
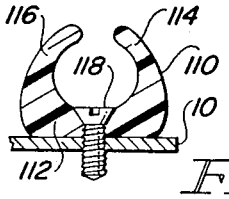
FIG. 4

COMBINATION HOOD SUPPORT, JACK CRANK, LUG WRENCH AND WHEEL COVER REMOVAL APPARATUS

BACKGROUND OF THE INVENTION

1. Field of the Invention

This invention relates to automotive vehicles, and more particularly, to a combination tool which includes a hood support element, jack crank element, a lug wrench, and a pry element for removing hub caps and wheel covers, for use in and with automotive vehicles.

2. Description of the Prior Art

Combination tools for automotive vehicles are not new. For example, it is not uncommon to find combination tools used for changing wheels, as for example, a combination lug wrench and wheel cover removal tool. Moreover, it is not uncommon to find a combination of jack crank and lug wrench. However, the jack crank in such cases is generally limited to the ratchet type bumper jacks, and the like. That type of jack includes a base and a jack element that moves upwardly or downwardly through ratcheting action.

For automotive vehicles in contemporary usage, particularly with compact vehicles, pickup trucks and the like, scissors jacks, or screw jacks are relatively common. These kinds of jacks require a rotary motion for raising and lowering them, rather than a pumping action or pivoting action as is common with bumper jacks. The scissors type or screw type jacks require a substantially greater lever arm than is required by the bumper jacks.

U.S. Pat. No. 3,649,976 (Isom) discloses a combination tool for use with vehicle wheels. The tool combines the function of a lug wrench, jack handle, and wheel cover removal tool. Moreover, the tool has a flange and an aperture through the flange which receives a bolt for locking the spare tire and the tool in place.

U.S. Pat. No. 3,779,106 (Cavicchi) discloses a combination lug wrench, wheel cover remover tool, and bumper jack crank.

U.S. Pat. No. 4,586,579 (Matsui et al) discloses a particular structure for supporting a hood. The apparatus is not a combination tool, but rather is specifically designed to support the hood of an automotive vehicle.

U.S. Pat. No. 4,607,406 (Davis, Jr.) discloses a combination tool which includes the combination of a socket wrench for removing lug bolts and a crank handle at the opposite end of the tool from the socket wrench. The lug wrench portion and the crank handle portion both pivot or fold to provide additional leverage for the respective functions. In addition, the central portion of the combination tool is also foldable for storage purposes and it locks in the open, extended position when the apparatus is used either as a lug wrench or as a jack handle. The overall length of the apparatus, and the folding elements, renders the apparatus usable as a jack handle for screw jacks.

SUMMARY OF THE INVENTION

The invention described and claimed herein comprises a tool which is a combination hood support rod, crank for a scissors jack or screw jack, a lug wrench, and a pry tool for removing wheel covers/hub caps. The tool includes an elongated element and a relatively short arm bent at a predetermined angle, which is about 90°, and the apparatus pivots from a storage position upwardly to a hood support position, with the elongated element supporting the hood. The apparatus is removable from the engine compartment when it is used as a jack handle and lug wrench. Removed from the engine compartment, the tool may be separated to use the lug wrench tool portion and the hub cap/wheel cover tool portion. The bent or angled portion may also include a pivoting crank arm to facilitate the use of the apparatus as a jack handle. Appropriate clamp elements in the engine compartment allow for the apparatus to be stowed in place, allow it to be pivoted and retained in its hood support operative position, and allow it to be easily removed for use as a jack crank and lug wrench.

Among the objects of the present invention are the following:

To provide new and useful combination tool apparatus;

To provide new and useful tool apparatus combining the functions of supporting a hood, cranking a jack, and removing and replacing a wheel and wheel cover;

To provide new and useful apparatus for supporting a hood of an automotive vehicle;

To provide a new and useful apparatus for removing an automobile's wheel and wheel cover;

To provide new and useful apparatus for cranking a jack with a rotary movement;

To provide new and useful combination tool apparatus movable in an engine compartment of an automotive vehicle from a stowed position to a hood support position and removable from the engine compartment for use as a crank handle;

To provide new and useful tool apparatus for removing hub caps/wheel covers from an automotive vehicle;

To provide new and useful tool apparatus for removing lug nuts from vehicle wheels; and To provide new and useful combination tool apparatus for supporting a hood, cranking a jack, removing lug nuts, and removing wheel covers/hub caps.

BRIEF DESCRIPTION OF THE DRAWING

FIG. 1 is a perspective view of the apparatus of the present invention in its use environment.

FIG. 2 is an enlarged perspective view of the apparatus of the present invention.

FIG. 3 is an enlarged perspective view of a portion of the apparatus of the present invention taken generally from Circle 3 of FIG. 2.

FIG. 4 is an enlarged view in partial section taken generally along line 4—4 of FIG. 3.

FIG. 5 is a view in partial section taken generally along line 5—5 of FIG. 3.

FIG. 6 is an enlarged perspective view of a portion of the apparatus of the of the present invention, taken generally from circle 6 of FIG. 2.

FIG. 7 is an enlarged view of a portion of the apparatus of the present invention taken generally from Circle 7 of FIG. 1.

FIG. 8 is a view in partial section taken generally along line 8—8 of FIG. 7.

FIG. 9 is an enlarged perspective view of an element useful with the apparatus of the present invention.

DESCRIPTION OF THE PREFERRED EMBODIMENT

FIG. 1 is a perspective view of the front portion of a vehicle 2, illustrating a combination tool apparatus 30 of the present invention in one of its use settings or positions. The vehicle 2 includes a front engine compartment 4 and a hood 6. The hood 6 is supported in its "up" position by the apparatus 30. At the front of the engine compartment 4, and beneath the hood 6, are, insofar as they relate to the apparatus of the present invention, three sheet metal portions. The sheet metal portions are respectively designated as a front sheet metal apron 8, a left side sheet metal apron 10, and a right side sheet metal apron 12. As is well known and understood, the hood 6 latches, and is accordingly secured, in its "down" position to the front apron 8. When the hood is open, the side aprons 10 and 12 are exposed and are accessible. The apparatus 30 of the present invention is disposed, in its down or stowed/storage position, on both the front apron 8 and the left side apron 10.

The apparatus 30 of the present invention is a multi-functional apparatus which includes several discrete portions and some of the portions are separable or removable to enable them to be used to perform their separate functions, as desired, or as required.

FIG. 2 is a perspective view of an apron 8 of the apron 10, with the appratus 30 shown disposed thereon. FIG. 3 is an enlarged view of a portion of the apron 12, taken generally from Circle 3 of FIG. 2.

The apparatus 30 includes a base member or rod 32, disposed generally along the apron 10. The base member or rod 32 includes an elbow 36, and an arm 38 extending substantially ninety degrees to the base member or rod 32. The arm 38 is in turn appropriately secured, as will be discussed in detail below, to an extension member or rod 50. The rod portions 38 and 50 are disposed on the apron 8, as best shown in FIG. 2, in the stowed position. For supporting the hood 6 in its up position, the rod portions 38 and 50 are pivoted upwardly from the apron 8.

Towards the outer end of the extension member 50, remote from the elbow 36, is a support bow 58. As best shown in FIG. 1, the support bow 58 cooperates with an appropriate structural portion of the hood 6 to enable the apparatus 30 to support the hood 6.

Adjacent to the support bow 58 is a square tip portion 60. The square tip portion 60 terminates in a flat end 62. As will be understood, the square tip portion 60 may also be of a hexagonal configuration, or any other appropriate configuration to mate with a jack fitting (not shown).

The apparatus 30 is secured to the aprons 8 and 10 by appropriate brackets, details of which are shown in FIGS. 3, 4, 5, and 6.

FIG. 3 is a perspective view of a portion of the aprons 8 and 10, illustrating four of the brackets associated with the apparatus 30. The four brackets include an end bracket 100, a spring bracket 110, a corner bracket 120, and a spring bracket 140. In FIG. 3, the end bracket 100 is shown, the spring brackets 110 and 140 are shown, and the corner bracket 120 is shown.

FIG. 4 is a view in partial section of the spring bracket 110, taken generally along line 4—4 of FIG. 3. FIG. 5 is a view in partial section taken generally along line 5—5 of FIG. 3. The end bracket 100, the spring bracket 110, the corner bracket 120, and the spring bracket 140 are shown.

FIG. 6 is a perspective view of a portion of the apron 8, illustrating a fifth bracket, a spring bracket 130. The spring bracket 130 is secured to the apron 8 adjacent to the bow 58 and the end 60 of the rod 50.

For the following general discussion, reference will primarily be made to FIGS. 1-6.

The base member of rod 32 includes a flat end 34. The base member or rod 32 is disposed within the end clamp 100 and within the spring clamp 110. The bracket 120 limits the rearward travel of the rod 32, and the corner bracket 120 limits the forward travel of the rod 32. Thus, the brackets 100 and 120 confine the apparatus 30 when it is used as a hood support element and help to hold the apparatus 30 when it is stowed. (See FIG. 2.)

The end bracket 100 is a generally U-shaped bracket. It includes a base element or portion 102 and two arms 104 and 106 extending upwardly from the base element 102. A screw 103 extends through the base element 102 to secure the bracket 100 to the apron 10.

The arm 106 includes an aperture or hole 108 through which the end portion of the rod 32 extends. The end 34 of the rod 32 abuts the arm 104 to limit the movement of the rod 32 and the apparatus 30 is a rearward direction.

The corner bracket 120 is of a generally L shaped configuration. It includes a horizontally extending base portion 122 and a vertically extending arm portion 124. A pair of screws 126 is used to secure the base 122 to the apron 8. The vertical arm 124 is disposed generally parallel to the arm portion 38. The center of the arm 124 is generally aligned with the spring bracket 110. The plate or arm 124 limits the forward movement of the apparatus 30. The elbow 36 abuts the arm 124 to limit the movement and to brace the apparatus 30 when the apparatus 30 is used to support the hood 6 by pivoting the rod 50 through ninety degrees from its stowed position to the upright position. This is shown in FIG. 1.

The spring bracket 110 (See FIG. 4) includes a base 112 disposed on the apron 10 and secured thereto by a screw 118. A pair of spring arms 114 and 116 extend upwardly from the base 112. The rod 32 is disposed within the spring bracket 110 and is held therein by the generally inwardly directed bias of the arms 114 and 116.

Remote from the corner bracket 120 is the spring bracket 130. The spring bracket 130 is best illustrated in FIG. 6. The spring bracket 130 is substantially identical to the spring bracket 110. The bracket 130, shown in an enlarged perspective view in FIG. 6, includes a base portion 132 and a pair of arm portions 134 and 136 secured to the base 132 and extending upwardly therefrom. A screw 138 extends through the base 132 to secure the base 132 to the apron 8. In its down or stowed position, the extension rod 50 is disposed in the bracket 130 and is held therein by the generally inwardly directed spring bias of the arms 134 and 136. The spring bracket 130 is disposed relatively close to the bow 58 and to the end portion 60 of the rod 50.

The rod portions 32 and 38 are joined together by an elbow 36 as discussed above. The elbow 36 comprises a substantially ninety degree turn, and the rod portions 32 and 38 are accordingly substantially perpendicular to each other.

The rod portions 38 and 50 are secured together by a sleeve 70. Details of the sleeve 70 and the juncture of the rod portion 38 and 50 are shown in FIGS. 7 and 8. FIG. 7 is an enlarged view of the sleeve 70, and the rod portions 38 and 50. FIG. 8 is a view in partial section taken generally along line 8—8 of FIG. 7.

The rod portion 38 terminates in a blade end 40. The blade end 40 is designed to comprise a pry tool for removing wheel covers, hub caps, and the like. In order to utilize the blade end 52, the sleeve 70 is released to allow the rod portions 38 and 50 to be separated from each other. In order to accomplish the separation, the apparatus 30 is removed from the brackets 100, 110, 130, and 140, and the sleeve 70 is then released to allow the rod portions 32 and 38 to be separated from the rod portion 50.

The rod portion 50 includes a socket or blade seat end 52 for receiving the blade end 40 of the rod portion 38. The socket blade seat end 52 receives the blade end 40, and the two portions are locked together by the sleeve 70. Adjacent to the seat 52 is a circumferentially extending groove 54 in the rod 50. The circumferentially extending groove 54 cooperates with the sleeve 70.

The sleeve 70 is a generally cylindrical element which includes an end 72 disposed over the rod portion 38. Extending longitudinally or axially with respect to the sleeve 70 from the end 72 is a lug slot 74. The lug slot 74 includes a circumferentially extending portion 76, remote from the end 72. At the end of the circumferentially extending slot 76, remote from the slot 74, is a relatively short longitudinally or axially extending locking lug slot 78.

At the opposite end of the sleeve 70 from the end 72 is a radially inwardly extending end wall 80. The end wall 80 is disposed within the circumferentially extending slot or groove 54. An opening 82 extends through the wall 80. The opening 82 is diametrically larger than the rod 50 at the groove 54, but the opening is not diametrically as large as the rod portion 50.

Within the slot 54 is a compression spring 84. The compression spring 84 extends between the groove 54 and the end wall 80 to bias the sleeve to lock the rod portions 38 and 50 together.

A radially extending locking lug 44 extends outwardly from the arm 38 adjacent to the blade end 40. The locking lug 44 cooperates with the slots 74, 76, and 78 of the sleeves 70 to lock the sleeve 70 in place over the rod portions 38 and 50. The compression spring 84 biases the sleeve to maintain the locking lug 44 in the slot 78.

For releasing the rod portions 38 and 50, as may be visualized in FIGS. 7 and 8, the sleeve 70 is moved against the bias of the spring 80 axially to move the lug 44 out of the slot 78 and into the circumferentially extending slot 76. The sleeve 70 is then rotated to move the lug 44 into the slot 74. With the lug 44 in the slot 74, the rod portion 38 may be removed from the blade seat or socket 52. With the rod portion 38 removed, the rod portion 38, secured to the rod portion 32, mmay then be used as desired. However, since the end wall 80 is disposed within the groove 54, the sleeve 70 will be retained on the rod portion 50. The rod portions 38 and 32 have two separate functions, one of which, the use of the tip 40 as a pry tool, has been discussed. The second function will be discussed next.

In addition to the blade end 40, the rod portions 32 and 38 include another tool which comprises a dual functioning element, namely a crank handle/lug wrench combination element 90. The element 90 includes a socket 92 at its outer end. The socket 92 comprises a lug wrench socket for removing lug nuts on the wheels of the vehicle 2.

Remote from the socket 92 is an end 94. The end 94 includes an aperture 96 extending through it. The rod portion 32 extends through the aperture 96. The crank handle/lug wrench element is retained on the rod 32 by a radially extending locking lug 42. The locking lug extends outwardly from the rod 32. The locking lug 42 is disposed between the crank handle/lug wrench element 90 and the end 34 of the base member or rod 32. As best shown in FIG. 2, the locking lug 42 is disposed adjacent to the arm 106 of the end bracket 100.

With the rod portions 32 and 38 removed from the rod portion 50, the crank handle/lug wrench element 90 is available for use in removing and tightening/installing lug nuts against wheels. The rod portion 32 and the rod portion 38 provide desired leverage for removing and/or installing the lug nuts, as desired by the user of the apparatus. The lug wrench element 90 is disposed adjacent to its locking lug 42 to provide a maximum lever arm between the lug wrench 90 and the rod 38. On the other hand, if desired, the lug wrench element 92 may be moved along the rod portion 32 to a central location to allow equal lever arms on opposite sides of the lug wrench 90 on the rod 32.

For stowage, the crank handle/lug wrench element 90 is disposed in the spring bracket 140. Since the diameter of the element 90 is greater than that of the rods 32 and 50, the spring bracket 140 is slightly larger. Otherwise, the spring bracket 140 is substantially identical to the spring brackets 110 and 130.

The spring bracket 140, as best shown in FIG. 5, includes a base element 142 and a pair of arms 144 and 146. The spring bracket 140 is secured to the apron 10 by a screw 148. The screw 148 extends through the base element 142.

For joining together the rod portions 38 and 50, the reverse of the operation steps discussed above is employed. The blade 40 is inserted in the socket 52, and the slot 74 of the sleeve 70 is aligned with the locking lug 44. The locking lug 44 is then moved in the slot 74. The sleeve 40 is moved axially against the compression spring 84 and is then rotated to move the locking lug 44 in the slot portion 76. The lug portion 44, as it is aligned with the axially extending slot 78, is then locked in the slot 78 by releasing the sleeve 70. The bias of the compression spring 84 moves the sleeve 70 axially with respect to the rods 38 and 50 to lock the lug 44 in the slot portion 78. The sleeve 70 is thus secured to both the rod portions 38 and 50 to secure the rod portions 38 and 50 together.

With the rod portions 38 and 50 secured together, the apparatus 30 may then be used as a crank rod for cranking the scissors-type jacks which are typically used in pickup trucks and the screw-type jacks also used in such vehicles.

The use of the apparatus 30 as a crank element is accomplished by removing the apparatus 30 from its brackets 100, 110, 130, and 140. The square end portion 60 is inserted into the appropriate jack receptacle, and the crank handle/lug wrench 90 is pivoted 180 degrees from the position shown in FIGS. 1 and 2. The combination element 90 then becomes a crank handle with the rod portion 32, between the elbow 36 and the crank handle 90, comprising the lever arm for the crank.

FIG. 9 is a perspective view of an alternate end bracket 150 which may be used in place of the end bracket 100. The alternate end bracket 150 includes a base portion 152 and a pair of arms 156 and 160. The base 152 includes an aperture 154 extending through it. The aperture 154, of course, receives a screw (not shown) to secure the bracket 150 to the apron 10.

The arm 156 includes a slot 158 to receive the rod portion 32. For using the bracket 150, it would be preferable to have a relieve portion on the rod 32 so that the relieved portion may extend through the opening or slot 158. Then, when the rod 160 is pivoted, the relieve portion is rotated so that the wide portion of the rod 132 is disposed transversely within the widened portion of the slot 158. Or, in the alternative, the bracket 150 may be made of an elastomeric material, with the arm 156 and its slot 158 able to deform or receive the upper portion of the slot 158 when the rod 132 is moved into the slot 158. The arm 160 acts as a stop element for limiting the rearward movement of the apparatus, just as does the arm 104 of the bracket 100.

It will be noted that the blade end 40 has been described as being on the end of the arm 38. This, of course, necessitates the blade seat 52 on the end of the extension rod 50. If desired, the blade end 40 could be located on the base member or rod 32 in place of the flat end 34. In such case, the flat end 34 would be located on the end of the arm 38. Instead of a flat end 34 on the arm 38, the end could be configured as desired for convenient securing to the extension arm 50. A sleeve, such as the sleeve 70, or some other appropriate sleeve-like member, would still be used to connect the extension rod 50 to the arm 38.

In case of the transposition of ends, as discussed in the preceding paragraph, the crank handle/lock wrench element 90 would, when the base member 32 and its arm 38 is used as a pry tool, be moved to a location substantially adjacent to the arm 38.

Moreover, the juncture of joint between the extension rod 50 and the base element or arm 32 could be at the elbow 36, if desired. This design would, of course, obviate the need for the relatively short arm 38. With this design, the blade end 40 could still be located at either end of the base arm 32. Again, an appropriate joint or securing element(s) would be used to secure the arms together.

Finally, it will also be noted that the juncture between the extension rod 50 and the base arm 32 could be a socket joint. In such case the arm 38 would comprise a lug wrench, with its socket receiving the mating end of the arm 50. A crank handle element, in place of the element 90, would still be employed. Essentially, this configuration would substitute the element 90 for the arm 38. However, for convenience, the substitution would still require that the crank arm be movable relative to the base arm or element 32 for the reason discussed above, such as the need for a stowed position and a crank position.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Tool apparatus for a vehicle having a hood, wheels secured to the vehicle by lug nuts, and a jack for raising the vehicle, comprising, in combination:

a base member having a first end;

a first arm connected to the base member and extending substantially at a right angle to the base member;

a blade end on the first arm defining a prying tool;

an extension arm having an outer end;

means for connecting the extension arm to the first arm at the blade end;

support means adjacent to the outer end of the extension arm for supporting the vehicle hood;

jack connecting means at the outer end of the extension arm for securing the extension arm, the first arm, and the base member to the jack for cranking the jack; and lug wrench means disposed on the base member comprising a lug wrench for the vehicle lug nuts when the base member and the first arm is separated from the extension arm and comprising a crank handle when the extension arm is secured to the first arm and the outer end of the extension arm is connected to the jack.

2. The apparatus of claim 1 in which the means for connecting the extension arm to the first arm comprises a sleeve disposed over the extension arm and the blade end of the first arm.

3. The apparatus of claim 2 in which the sleeve is secured to the extension arm.

4. The apparatus of claim 2 in which the extension arm includes a blade seat for receiving the blade and remote from the outer end, and the sleeve is disposed at the blade seat.

5. The apparatus of claim 1 in which the support means comprises a bow in the extension arm adapted to contact and hold the hood for supporting the hood.

6. The apparatus of claim 1 in which the lug wrench means includes a generally cylindrical portion, a socket for receiving a lug nut, an end remote from the socket, and an aperture extending through the cylindrical portion adjacent to the end, and the base member extends through the aperture.

7. The apparatus of claim 6 in which the lug wrench means is movable on the base member from a wrench use position when the lug wrench means is used as a lug wrench to a crank position when the lug wrench means is used as a crank handle.

8. The apparatus of claim 7 in which the base member includes means for securing the lug wrench means to the base member.

9. The apparatus of claim 1 which further includes means for securing the tool apparatus to the vehicle and to permit the tool means to pivot from a stored position through an angle of substantially ninety degrees to a hood support position.

10. Tool apparatus for a vehicle having a hood, a wheel secured to the vehicle by lug nuts, a covering on the wheel over the lug nuts, and a jack for raising the vehicle, comprising, in combination:

support rod means for supporting the hood and having an outer end securable to the jack;

base rod means securable to the support rod means remotely from the outer end and comprising a crank arm when the support rod means is secured to the jack and comprising a base element when the support rod means supports the hood, and removable from the support rod means, and including, when removed from the support rod, a pry end for prying the cover from the wheel, and lug wrench means for removing and for tightening the lug nuts; and means for securing the support rod means to the base rod means.

11. The apparatus of claim 10 in which the support rod means includes a support rod and means for securing the support rod to the hood.

12. The apparatus of claim 11 in which the means for securing the support rod to the hood includes a bow adjacent to the outer end.

13. The apparatus of claim 10 in which the means for securing the support rod means to the base rod means includes a sleeve extending over a portion of the support rod means and a portion of the base rod means.

14. The apparatus of claim 13 in which the pry end of the base rod means extends into the sleeve.

15. The apparatus of claim 13 in which the support rod means includes a seat for receiving the pry end of the base rod means.

16. the apparatus of claim 10 in which the base rod means further includes a base rod, and the lug wrench means includes a handle movably secured to the base rod, and a socket for receiving a lug nut remote fromm the base rod.

* * * * *